US007438467B2

(12) United States Patent
Borger

(10) Patent No.: US 7,438,467 B2
(45) Date of Patent: Oct. 21, 2008

(54) ASSEMBLY AND METHOD FOR EVALUATING FIRE PERFORMANCE OF SHEET PILING SECTIONS

(75) Inventor: David Borger, Morristown, NJ (US)

(73) Assignee: Skyline Steel, LLC, Parsippany, NJ (US)

( * ) Notice: Subject to any disclaimer, the term of this patent is extended or adjusted under 35 U.S.C. 154(b) by 148 days.

(21) Appl. No.: 11/542,823

(22) Filed: Oct. 4, 2006

(65) Prior Publication Data

US 2008/0084910 A1 Apr. 10, 2008

(51) Int. Cl.

| | |
|---|---|
| ***G01N 25/00*** | (2006.01) |
| ***G01K 1/14*** | (2006.01) |
| ***G01K 7/02*** | (2006.01) |
| ***G01K 7/16*** | (2006.01) |

(52) U.S. Cl. ..... 374/8; 374/141; 374/166; 374/110; 374/179; 374/183; 374/102

(58) Field of Classification Search ..... 374/8, 374/16, 57, 51, 141, 166, 110, 179, 183
See application file for complete search history.

(56) References Cited

U.S. PATENT DOCUMENTS 7,127,865 B2 * 10/2006 Douglas ..... 52/745.13

* cited by examiner

*Primary Examiner*—Edward Lefkowitz
*Assistant Examiner*—Mirellys Jagan
(74) *Attorney, Agent, or Firm*—Hoffmann & Baron, LLP

(57) ABSTRACT

An assembly and method for testing the fire performance of sheet piling sections which includes: a first wall formed from sheet piling sections; a second wall substantially parallel to the first wall; a base plate; and a pair of end sections extending between the opposing ends of the two walls. The first and second walls and the end sections are attached to, and extend upwardly from, the base plate to form a cavity, which can be filled with materials. The assembly also includes two top sections, which are attached to the first and second walls and joined together by at least one connector. The sheet piling sections of the first wall are exposed to a heat source to certify compliance with fire codes and regulations.

28 Claims, 4 Drawing Sheets

ASSEMBLY AND METHOD FOR EVALUATING FIRE PERFORMANCE OF SHEET PILING SECTIONS

FIELD OF THE INVENTION

The present invention relates to an assembly used for the fire performance testing of sheet piling sections and the method used for performing the testing. In particular, the invention relates to fire performance testing to ensure that sheet piling sections comply with fire performance standards set forth in building and fire codes.

BACKGROUND OF INVENTION

Typically, sheet piling sections are used as ground barriers for preventing the passage of water or the shifting of the ground during excavation. In such traditional uses, there is very little chance that the sheet piling sections will be subjected to the high temperatures resulting from a fire and, therefore, the sheet piling sections have not been required to be fire resistant or comply with any fire performance standards. However, as new uses have been found for sheet piling sections in the construction of buildings and parking garages, it has become necessary for sheet piling sections to comply with the standards adopted for traditional building materials.

One of the most widely accepted standards for fire performance testing is ASTM (American Society for Testing and Materials) E-119, titled "*Standard Test Methods for Fire Tests of Building Construction and Materials*." ASTM E-119 has been used to test a wide variety of building materials, in particular the performance of walls, columns, floors and other building members under fire exposure conditions, to ensure the construction of safe structures. Many government agencies and municipal authorities have recognized the value of ASTM E-119 and have incorporated it into their building codes and regulations. ASTM E-119 is used to measure and specify the fire-resistive properties of materials and assemblies in accordance with a common standard that is expressed in terms that can be applied to various materials, situations and conditions of fire exposure.

Because sheet piling sections have only recently been used in applications where it is necessary to comply with municipal and other building codes, there has not been developed an assembly and test method for testing the fire resistance of sheet piling sections. More specifically, there has not been developed an assembly and test method for conducting fire resistance testing that complies with ASTM E-119. Accordingly, there is a need for an assembly and test method that can be used for testing the fire resistance of sheet piling sections as required under ASTM E-119 and other building codes and regulations.

SUMMARY OF THE INVENTION

In accordance with the present invention, an assembly for testing the fire performance of sheet piling sections is provided. The assembly includes: a first wall formed by at least one sheet piling section and having an exterior surface, an interior surface, a first top edge and a first pair of opposing ends; a second wall substantially parallel to the first wall and having a second top edge and a second pair of opposing ends; a base plate; and a pair of end sections extending between the first pair of opposing ends and the second pair of opposing ends. The first and second walls and the pair of end sections are attached to, and extend upwardly from, the base plate to form a cavity. Preferably, the second wall is constructed from a plurality of sheet piling sections and can include one or more apertures. The assembly can also include: a first top section attached to the first top edge; a second top section attached to the second top edge; and at least one connector, wherein the first top section is joined to the second top section by at least one connector. The connector is preferably a bolt, a strap or a connecting plate and combinations of two or more bolts, straps and connecting plates can be used.

The interior surface of the first wall faces the second wall and a plurality of temperature measuring devices contact the interior surface of the first wall. Preferably, the temperature measuring devices are thermocouples or resistance temperature detectors. When the assembly is used to test the fire performance of the first wall, the exterior surface of the first wall is exposed to temperatures of at least 500° F. The temperature measuring devices monitor the temperatures at different locations on the interior surface of the first wall during the tests to verify that the sheet piling sections were subjected to prescribed test conditions.

The assembly can be formed by attaching the first wall, second wall, the pair of end sections and the base plate by a plurality of bolts, a plurality of rivets, a plurality of welds or a combination of two or more thereof. The cavity formed in the assembly is adapted to contain solid materials or a combination of solid and liquid materials, preferably sand or a mixture of sand and water. These materials simulate the conditions that exist when a sheet piling section is used as a wall in an underground structure. The type of material or materials placed in the cavity can be changed as required by the test procedures that are being used.

The first wall of the assembly is formed by a plurality of adjoining sheet piling sections, each having a pair of side edges. The side edges of the sheet piling sections interlock with the side edges of the adjacent sheet piling sections to form a plurality of joints. These joints can be welded to provide a watertight seal. The assembly of the interlocking sheet piling sections and the connecting joints are well known to those of ordinary skill in the art.

The present invention also includes a method for testing the fire performance of sheet piling sections. The method includes constructing an assembly having: a first wall formed by at least one sheet piling section and having an interior surface, an exterior surface, a first top edge and a first pair of opposing ends; a second wall substantially parallel to the first wall and having a second top edge and a second pair of opposing ends, wherein the interior surface of the first wall faces the second wall; a base plate; and a pair of end sections extending between the first pair and the second pair of opposing ends. The first and second walls and the end sections are attached to, and extend upwardly from, the base plate to form a cavity. After construction of the assembly, the method further includes: placing materials in the cavity; providing a heat source of at least 500° F.; and exposing the exterior surface of the first wall to the heat source. The materials placed in the cavity are preferably solid materials or a combination of solid and liquid materials and, most preferably, sand or a combination of sand and water.

The assembly can also include: a plurality of temperature measuring devices in contact with the interior surface of the first wall; a first top section attached to the first top edge; a second top section attached to the second top edge; and at least one connector, wherein the first top section is joined to the second top section by the at least one connector. The temperature measuring devices are used to measure temperatures when the exterior surface of the first wall is exposed to the heat source. The measured temperatures are recorded over a period of time and can then be compared to a fire performance standard for building materials.

BRIEF DESCRIPTION OF THE FIGURES

The preferred embodiments of the assembly and method for testing the fire performance of sheet piling sections of the present invention, as well as other objects, features and advantages of this invention, will be apparent from the following detailed description, which is to be read in conjunction with the accompanying drawings wherein.

DETAILED DESCRIPTION OF THE INVENTION

Figure 1:
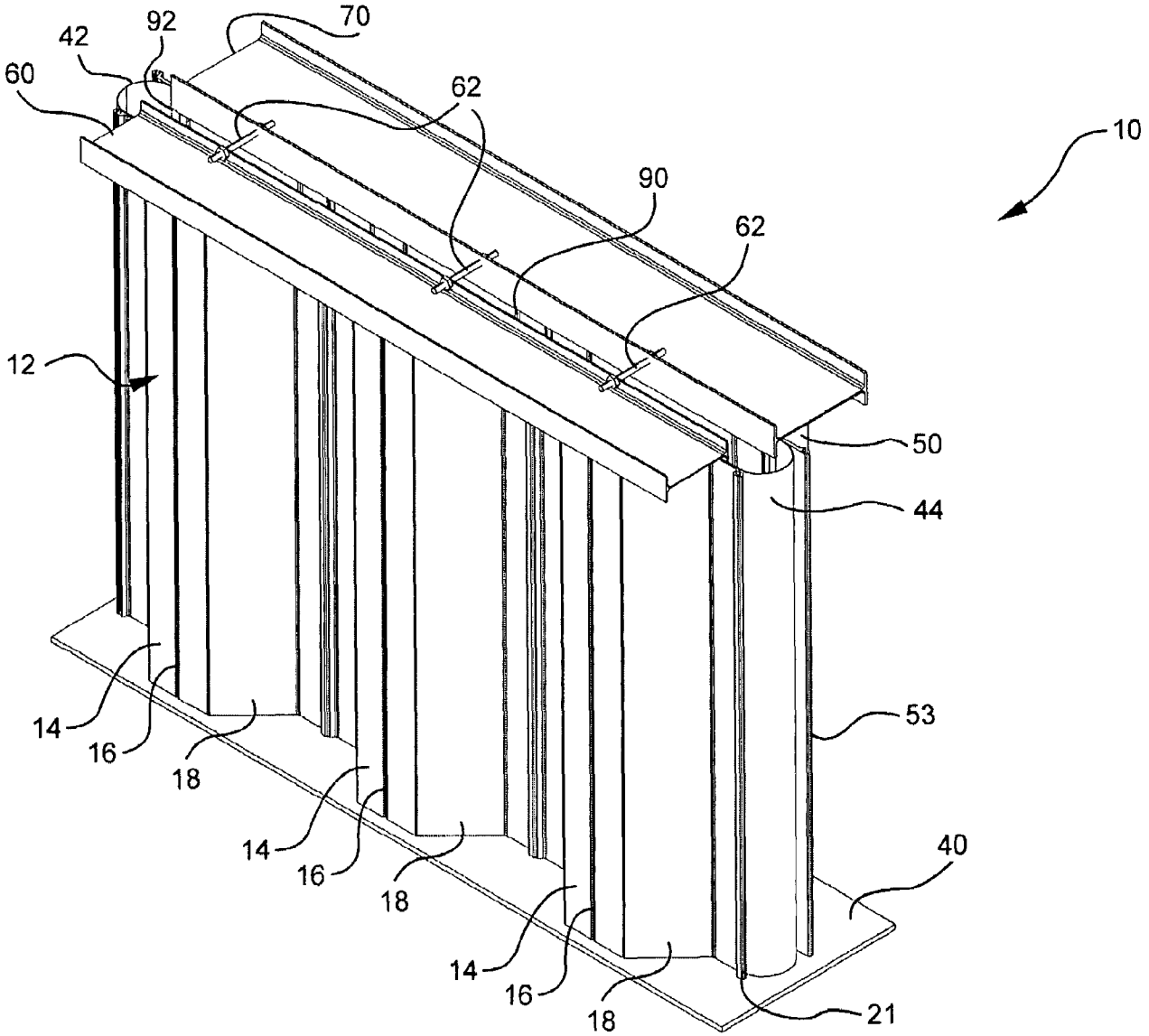
FIG. 1 is a perspective view of the assembly for testing fire performance of sheet piling sections.

The present invention is a test assembly that is used for evaluating the fire performance of sheet piling sections and the method that is used for such evaluation. The assembly and method can be used to evaluate sheet piling sections by conducting tests, which comply with ASTM E-119, the standard time-temperature curve and fire test for the fire resistance of building materials. The test determines the fire performance characteristics of a sheet piling wall, including the duration of time over which the sheet piling wall will contain a fire or retain its structural integrity. In some embodiments of the present invention, both of these characteristics can be monitored and displayed during a fire performance test.

The test assembly and method are used to measure the response of a sheet piling wall that is tested to the exposure of heat and hot gases. The assembly is intended to test sheet piling sections for compliance with recognized standards. These standards set forth the procedures for measuring and recording the properties of materials, products, or assemblies in response to heat and flame under controlled laboratory conditions. In addition, the results of the tests performed using the assembly and method of the present invention can be used as elements of a fire risk assessment, which takes into account all the factors that are pertinent to an assessment of the fire hazard of a particular end-use for sheet piling sections. To this end, the assembly is provided with a central cavity which can be filled with different materials to simulate the actual conditions of an installed sheet piling wall. For example, soil and/or sand similar to the location where the sheet piling sections will be installed can be placed in the cavity. Moreover, the moisture conditions can be simulated by adding water to the soil and/or sand.

The assembly of the present invention can be used to perform a fire performance test, which exposes a load-bearing sheet piling wall to fire conditions as set forth in the ASTM E 119 standard. The standard requires the fire to be controlled to achieve specified temperatures over a specified time period. These procedures are similar to most fire performance test procedures, which may differ with respect to duration and temperature requirements. The tests may also differ based on the load that is placed on top of the sheet piling section. The load simulates actual conditions where the wall is required to support a structure. For example, when sheet piling sections are used in the construction of underground parking garages, the walls may be required to support some of the weight of the floors.

The test assembly typically includes a first wall formed by a plurality of pairs of sheet piling sections and a second wall approximately the same length as the first wall, which is also formed by a plurality of pairs of sheet piling sections. The first wall is formed of the sheet piling sections which are to be tested for fire performance and the second wall provides structural support for the first wall. The two walls are attached to a base plate and a pair of end sections is attached at the opposing ends of the walls to form an enclosed space, or cavity, between the walls. The first and second walls each have a height defined by top and bottom edges and a width defined by the opposing ends. The bottom edges of the two walls are attached to the base plate so that the walls are spaced a minimum of 12 inches apart, substantially parallel to each other and substantially perpendicular to the base plate. A top section is attached to each of the first and second walls so that the top sections are spaced a minimum of about 6 inches from each other and are substantially parallel to each other and the base plate. The top sections define an opening between the two walls and are connected to each other at different points by bolts, metal straps or connecting plates. The construction of the assembly by the attachment of the first and second walls, the base plate, the end sections and the top sections is preferably done by welding the different components to each other. However, bolting, riveting and clamping can also be used in addition to welding.

The test assembly has a plurality of temperature measuring devices, preferably thermocouples or resistance temperatures detectors ("RTD's"), attached to the interior surface of the wall of sheet piling sections that is being tested. The use of these devices to measure temperatures in fire performance testing is well known to those skilled in the art. As used herein, the term "exterior wall surface" applies to the wall surface opposite the cavity and the term "interior wall surface" applies to the wall surface on the cavity side of the wall. When the exterior surface of the first wall is exposed to a heat source during testing, the temperature measuring devices measure the temperature of the sheet piling sections to determine their fire performance characteristics.

In a preferred embodiment of the assembly, a first wall, the sheet piling wall that is to be tested, is constructed of three pairs of sheet piling sections, each with a thickness of at least 0.375-inch, which are welded to a base plate. A second wall approximately the same length as the first wall is attached to the base plate so that it is substantially parallel to the first wall with a space in between. Preferably, the second wall is constructed from sheet piling sections, but it can also be constructed from substantially flat sheets of steel. The actual shape of the second wall is not a limitation of the present invention. A pair of end sections is then attached to the base plate so that they connect the first and second walls and define a cavity between the first and second walls. A first top section is attached to the first wall and a second top section is attached to the second wall. The two top sections are substantially parallel to each other with a space in between. The two top sections are attached to each other by one or more connectors, preferably a plurality of connectors. These connectors can be bolts, straps or metal plates welded on either end to the top sections. In preferred embodiments, all of the points where the different components of the assembly are attached to each other, they are welded to ensure a strong and watertight joint.

The joints which connect the first wall, i.e., the sheet piling wall that is to be tested, are continuously welded and the assembly structure restrains the first wall from bowing outward. Sand or other material is placed on the unexposed side of the first wall (i.e., in the cavity of the assembly) to simulate the actual conditions for a sheet piling wall installed in the ground. For this reason, it is preferred that the cavity have a minimum depth (i.e., the distance between the first and second walls) of at least 12 inches, and, more preferably, a minimum depth of 24 inches. When the first and second walls are constructed from sheet piling sections, the minimum depth is measured at the closest point between the two walls. The first wall is also structurally supported by the connection of the first and second top sections and the opposing end sections.

The second wall of the test assembly can include one or more apertures that can be used to introduce and/or remove materials from the cavity. In a preferred embodiment, apertures near the bottom of the second wall are used as drains to remove water or other liquids from the cavity. These apertures can be provided with doors which can be closed to seal the cavity during testing. The second wall can also have apertures for pipes which can be used for draining water from the cavity. These pipes can be provided with valves for shutting off the flow of water from the cavity or for regulating the flow. The doors and pipes allow materials to be removed after a test is completed and the cavity hosed out in preparation for another test.

After the assembly is constructed, it is placed next to a heat source, preferably a furnace, so that the high temperatures required for fire performance testing can be simulated. The procedure for placing the assembly next to the furnace and the operation of the furnace during the testing are well known to those of ordinary skill in the art and, therefore, need not be described in detail herein. The temperatures provide by the heat source are at least 500° F., and for many fire performance test temperatures of over 1000° F. are required. The exterior surface of the first wall of sheet piling sections that is being tested is exposed to the heat source. The plurality of temperature measuring devices in contact with the interior surface of the first wall is used to measure temperatures which are recorded over a period of time. These recorded temperatures can then be compared to a fire performance standard for building materials to determine if the sheet piling sections comply with the standard. In addition to the temperature measurements that are recorded during the test, the sheet piling sections can be visually inspected for warping and/or deformation. Strain gauges can also be attached to the sheet piling sections to monitor the effect of the load. After the test is completed and the assembly has cooled, the cavity is emptied and the sheet piling sections are inspected for any warping and/or deformation. The test results can be submitted to government agencies in applications for fire performance certification of the sheet piling sections.

The procedures for conducting fire performance tests under ASTM E 119 are well know to those skilled in the art and, therefore, a detailed description of ASTM E 119 is not included herein. The furnace exposure for fire testing building materials is set forth in Section 5 of ASTM E 119 and it provides a time/temperature curve for regulating the furnace environment throughout the duration of the exposure period. Points on the standard time/temperature curve are show in Table 1. These test points are intended as an example of how the assembly of the present invention can be used to test sheet piling sections, but it is not intended to limit the type or duration of tests that can e performed using the assembly.

TABLE 1

Points on the Time Temperature Curve

| TIME | TEMPERATURE |
|---|---|
| 0 minutes | Ambient |
| 5 minutes | 1000° F. (538° C.) |
| 10 minutes | 1300° F. (704° C.) |
| 30 minutes | 1550° F. (843° C.) |
| 45 minutes | 1638° F. (892° C.) |
| 60 minutes | 1700° F. (927° C.) |
| 2 hours | 1850° F. (1010° C.) |
| 3 hours | 1925° F. (1052° C.) |
| 4 hours | 2000° F. (1093° C.) |

Referring now to the drawings, FIG. 1 shows an assembly 10 for testing fire performance of sheet piling sections, which includes a first wall 12 formed by a plurality of pairs of sheet piling sections 14, 18 connected to each other and secured to a base plate 40. The assembly 10 is designed to test the fire performance of the first wall 12 of sheet piling sections 14, 18. In addition to the first wall 12, a second wall 50 of sheet piling sections 52, 54, approximately the same height and overall length as the first wall 12, is attached to the base plate 40 and is substantially parallel to the first wall 12, but is not intended to be tested for fire performance. The first wall 12 has a pair of opposing ends 11, 21 which approximately correspond to the opposing ends 51, 53 of the second wall 50 (see FIG. 2). A pair of end sections 42, 44 connects the first wall 12 to the second wall 50 near the opposing ends 11, 21 and 51, 53 of the first wall 12 and second wall 50, respectively.

FIG. 1 shows a first top section 60 attached to the top edge of the first wall 12, preferably by welding. Similarly, a second top section 70 is attached to the top edge of the second wall 50. The first top section 60 and the second top section 70 are substantially parallel with a opening 92 in between and are connected together by a plurality of connectors 62 (preferably bolts) at different points. When the first top section 60 and the second top section 70 are connected together, it provides structural stability for the first wall 12 and the second wall 50 and forms a cavity 90. The cavity 90 is bounded on the sides by the first wall 12 and the second wall 50, on the ends by the pair of end sections 42, 44, on the bottom by the base plate 40 and partially on the top by the first top section 60 and the second top section 70.

The cavity 90 can be accessed through the opening 92 between the first top section 60 and the second top section 70 for the addition of a material (not shown), which simulates the ground next to the sheet piling after it has been installed. The material is preferably sand or a combination of sand and water, although soil, rocks, gravel and other materials may also be used. The lower portion of the second wall 50 can include apertures (not shown) with doors for removing the solid materials and pipes, preferably supplied with valves, for draining liquids from the cavity 90. In one embodiment of the present invention, water is continuously added through the opening 92 between the top sections 60, 70.

Figure 2:
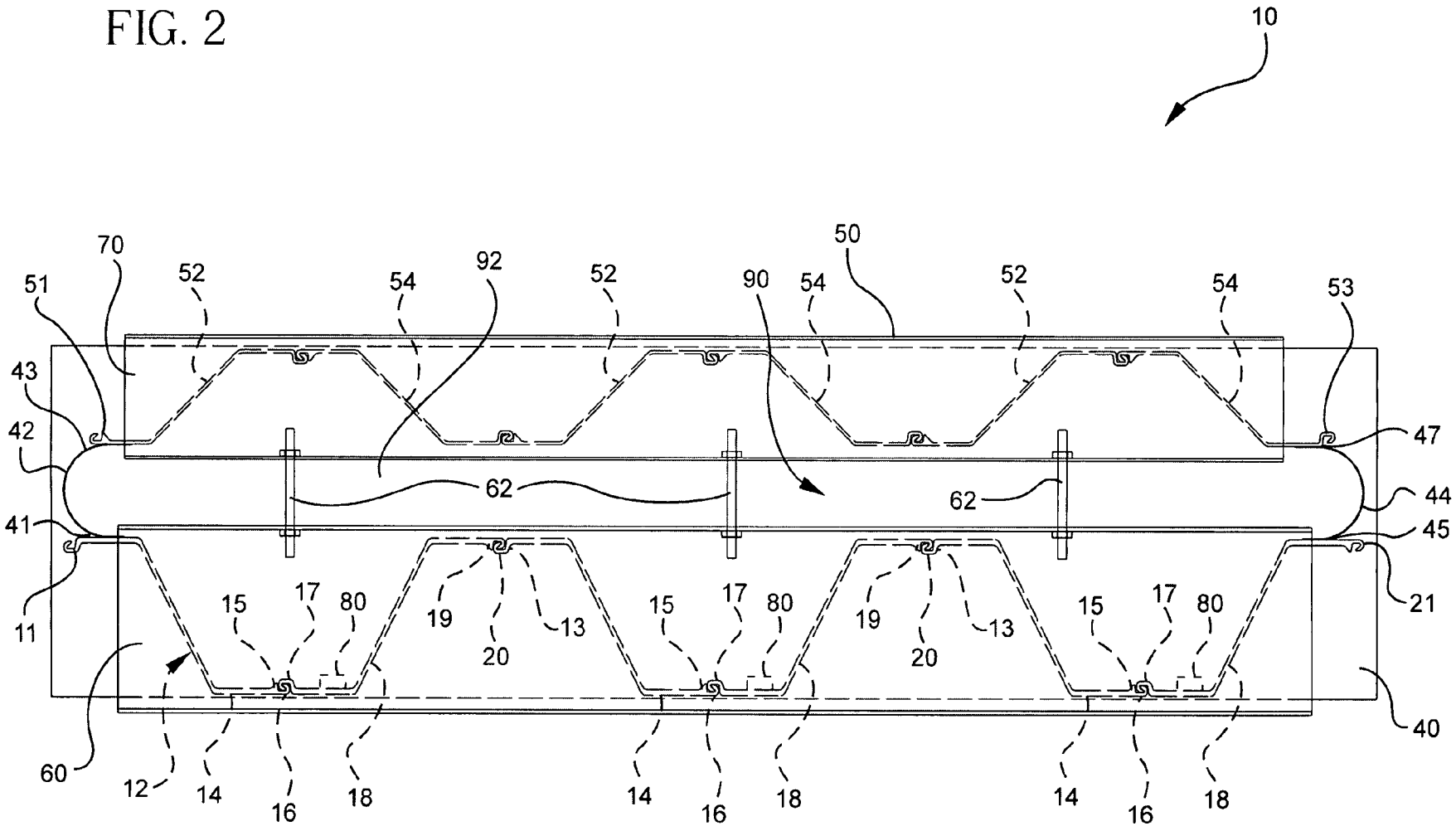
FIG. 2 is a top view of the assembly for testing fire performance of sheet piling sections.

FIG. 2 shows the first wall 12 formed by three pairs of Z-shaped sheet piling sections 14, 18, wherein the first sheet piling section 14 has a first end 11 that forms one of the ends of the first wall 12 and a second end 15, which interlocks with the first end 17 of the second sheet piling section 18 to form a joint 16. The second end 19 of the second sheet piling section 18 interlocks with the first end 13 of the first sheet piling section 14 of the adjoining pair of sheet piling sections to form a second joint 20. This configuration is repeated as additional pairs of sheet piling sections 14, 18 are added to the wall 12. The joints 16, 20 formed when the sheet piling sections 14, 18 are interlocked are preferably welded to ensure that the wall 12 is watertight.

As shown in FIG. 2, the pair of end sections 42, 44 of the assembly 10 are connected to the first wall 12 along a first pair of seams 41, 45, respectively, and to the second wall 50 along a second pair of seams 43, 47, respectively. The seams 41, 43, 45, 47 are preferably welded to form a watertight seal. The end sections 42, 44 and the bottom sedges of the first and second walls 12, 50 are also preferably welded to the base plate 40, while the first and second top sections 60, 70 are welded to the top edges of the first and second walls 12, 50. The plurality of connectors 62 secure the first and second top sections 60, 70 together and prevent movement of the first and second walls 12, 50 when the cavity 90 is filled with material.

As shown in FIG. 2, a plurality of temperature measuring devices 80 are attached to the interior surface (i.e., the side facing the second wall 50) of the first wall 12. The temperature measuring devices 80 are used to monitor the surface temperature of the first wall 12 during fire performance testing.

Figure 3:
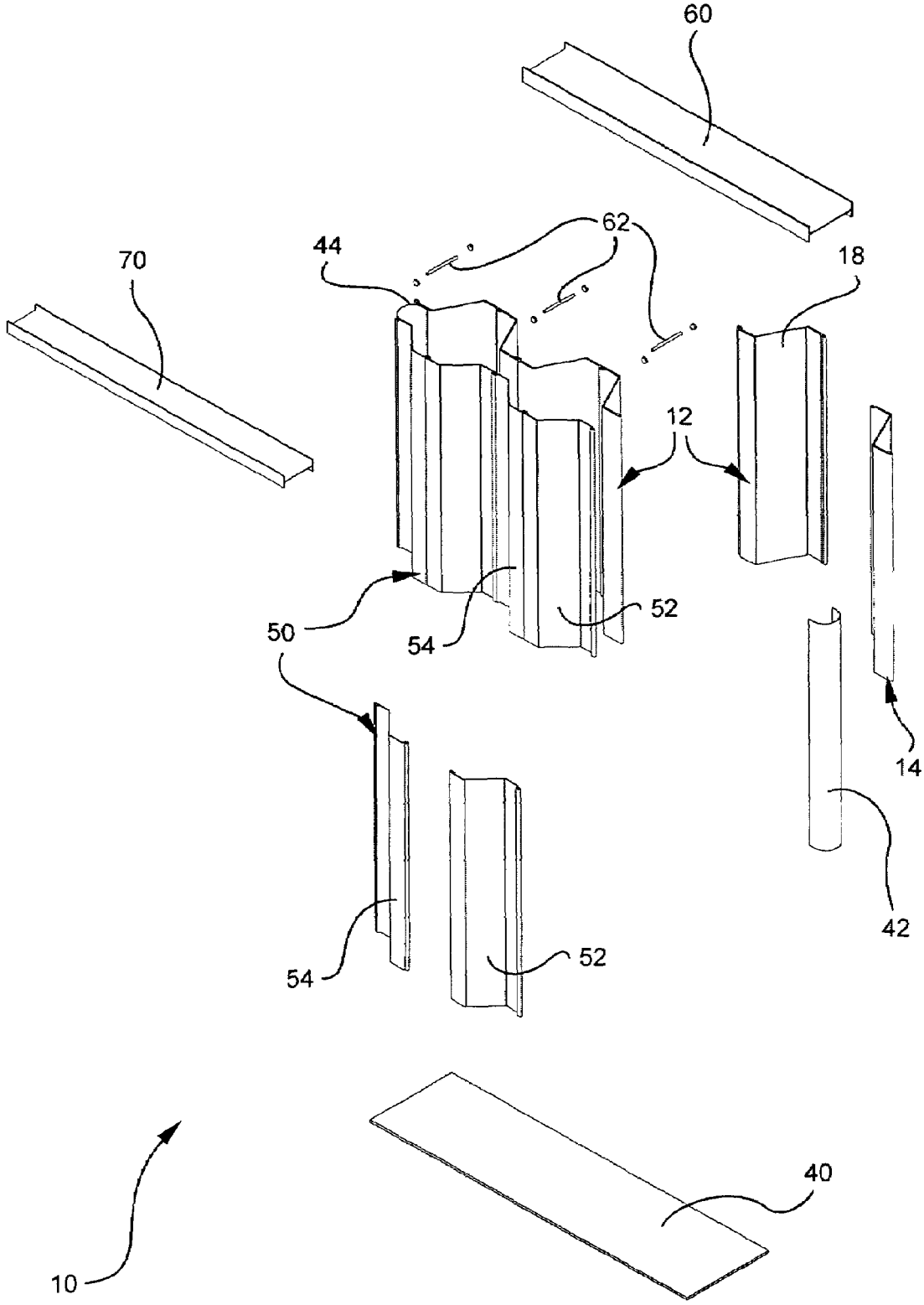
FIG. 3 is an exploded view of the assembly for testing fire performance of sheet piling sections.

FIG. 3 is an exploded view of the assembly 10 which illustrates the different components of the assembly 10 and how they are joined together. The first wall 12 is formed from a plurality of interlocking, Z-shaped sheet piling sections 14, 18 that are to be tested for fire performance. The second wall 50, which is not tested for fire performance, is also formed from a plurality of interlocking, Z-shaped sheet piling sections 52, 54. The pair of end sections 42, 44 are attached between the opposing ends of the first and second wall 12, 50 and the walls 12, 50 and end sections 42, 44 are attached to the base plate 40. The first top section 60 is attached to the first wall 12 and the second top section 70 is attached to the second wall 50. The two top sections 60, 70 are then connected to each other by a plurality of connectors 62.

Figure 4:
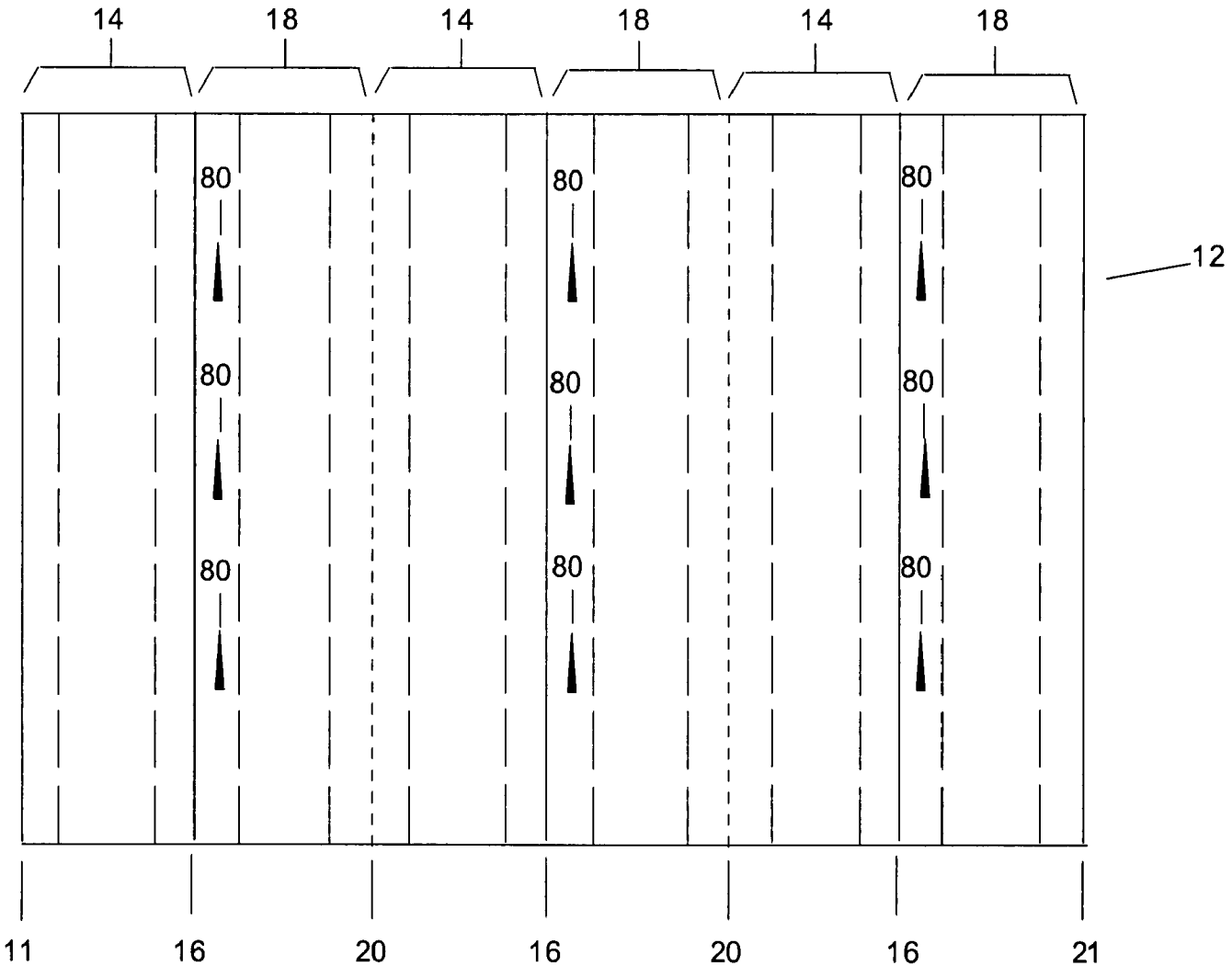
FIG. 4 is a side view of the interior wall of the assembly which shows a plurality of temperature detecting devices.

FIG. 4 shows a plurality of temperature measuring devices 80 attached to the interior surface of the first wall 12. The temperature measuring devices 80 are placed on the portion of the Z-shaped sheet piling sections 14, 18 that is closest to the heat source (see FIG. 2) to ensure that the maximum temperatures are measured. The location of the temperature measuring devices 80 can be changed as required to measure the temperature at different locations on the first wall 12. Preferably, the temperature measuring devices 80 are located at least 12 inches from the sides and top and bottom edges of the first wall 12 and evenly spaced from each other. More preferably, the temperature measuring devices 80 are located at least 24 inches from the sides and top and bottom edges. The number of temperature measuring devices 80 that are used is determined by the person conducting the test based on different government fire codes and regulations.

EXAMPLES

The examples set forth below serve to provide further appreciation of the invention but are not meant in any way to restrict the scope of the invention.

A sheet piling test assembly was constructed for the examples as shown in the perspective view in FIG. 1 and the plan view in FIG. 2. The test assembly included three pairs of interlocked AZ38-700 sheet piling sections welded together at the interlocking joints to form a first wall with overall dimensions of approximately 13 feet 9 inches wide and 8 feet 6 inches high with top and bottom edges and a pair of opposing ends. The test assembly also included three pairs of interlocked AZ13 sheet piling sections welded together to form a second wall with overall dimensions of approximately 13 feet 2 inches wide and 8 feet 6 inches high with top and bottom edges and a pair of opposing ends. The two walls were connected to each other near the opposing ends by two curved end sections of 12-gauge sheet metal having a height approximately the same as the two walls, which were welded to the ends of the walls. The two walls, the two end sections and the base plate formed a cavity between the two walls.

The bottom edges of the two walls and the end sections were welded to a 1-inch steel base plate to form a cavity with a minimum distance (i.e., the closest point between the two walls) of about 12 inches between the two sheet piling walls. A first beam (AISI Designation W16×26) approximately 13 feet in length was welded to the top of the first wall to form a first top section and a second beam (AISI Designation W24×55) approximately 13½ feet in length was welded to the top of the second wall to form a second top section. The two beams were bolted together at several points to provide structural stability to the top portion of the test assembly. All connections of the assembly were continuously welded so that the cavity was substantially watertight.

For the examples, a vertical furnace capable of fire performance testing of a specimen with maximum dimensions of 12½ feet high and 12½ feet wide was used as a heat source. The 40-inch deep furnace had nine flat-flame burners symmetrically placed across the back wall, which were controlled by a variable air-gas ratio regulator.

The temperature of the exposed exterior surface of the sheet piling sections of the first wall could not be monitored directly because of the high temperatures. Therefore, the interior surface was monitored. The unexposed, interior surface temperature of the first wall of sheet piling sections was monitored using nine No. 20 AWG (American Wire Gauge—also referred to as Brown & Sharpe (B&S) gauge), Type K (Chromel-Alumel) welded thermocouples (TCs), placed under flexible, dry, felted mineral fiber pads. The wire leads of the TCs terminate to form a tip, which is placed under the pad, in contact with the unexposed interior wall surface of the sheet piling sections. The pads were attached firmly to the wall surface to minimize any heat loss from the sides and to improve the accuracy of the measurement. Temperatures were monitored continuously throughout the test and recorded with computer data acquisition equipment for subsequent data reduction and analysis. When sheet piling sections are used in applications where they are driven into the ground, an unlimited amount of soil can be on one side of the sheet piling and the other side can be exposed to a fire scenario. Accordingly, an average temperature was simulated in the examples by placing the thermocouples in a pattern on the unexposed wall surface, similar to the arrangement shown in FIG. 4.

The fire performance test was conducted in accordance with the ASTM E 119, Section 5 time/temperature curve and the temperature was controlled based on the average temperature obtained from the readings of the nine thermocouples symmetrically spaced in a grid pattern on the non-exposed, interior surface of the sheet piling wall at a minimum of 2 feet from the edges of the wall. The furnace temperature during the tests was controlled such that the area under the time/temperature curve was within 10 percent of the corresponding area under the standard time/temperature curve for tests of 1 hour or less, 7.5 percent for those less than 2 hour, and 5 percent for those tests of 2 hour or more duration.

Example 1

In this example, the fire resistance of sheet piling sections in simulated wet conditions was tested. The sheet piling test assembly was mounted to a large vertical furnace so that the first wall with the AZ38-700 sheet piling sections was exposed to the furnace environment. The cavity between the first and second walls was filled with sand and water to simulate a wet condition. Instrumentation connections (i.e., the thermocouple wiring to the data acquisition computer) were verified and the fire performance test was conducted on the sheet piling wall at an ambient temperature of 79° F. and a relative humidity of 69 percent. Prior to ignition of the furnace, a 100-kip (kilopounds) load was applied to the top of the first wall of sheet piling sections to simulate the loading from a structure and a 0.14-inch deflection was observed. The fire exposure was initiated and water was intermittently added to the cavity keep the sand in the assembly at a saturated state. The fire exposure was terminated at 126 minutes. Visual observations of the test are summarized in Table 2.

TABLE 2

Visual Observations

| TIME (Min:Sec) | OBSERVATION |
|---|---|
| 0:00 | Start test. |
| 1:30 | Steel temperature rising quickly on unexposed AZ38-700. |
| 3:00 | Adjusting regulator on hydraulic pump to keep the load of 100-kips. |
| 6:00 | Water beginning to evaporate from system. |
| 6:30 | Introduced more water into cavity to replenish evaporated water. |
| 8:00 | Water supply shut off. |
| 12:00 | Burners set to full throttle to keep up with standard time-temperature curve. |
| 18:00 | Introduced more water into system. |
| 21:00 | Water supply shut off. |
| 27:00 | Continue to introduce water to keep up with loss of water through evaporation. |
| 40:00 | Water is set to add continuously. |
| 60:00 | Test time extended beyond scheduled 1-hour test. |
| 96:00 | Water shut off to observe the outcome. |
| 103:15 | TC 9 reaches 1000° F. |
| 120:00 | Test time extended beyond 2-hours. |
| 126:00 | Furnace shut off. Test terminated. |

The assembly did not allow the passage of flames and was capable of maintaining a 100-kip load during the fire resistance period. The assembly was allowed to cool and disassembled to make closer examination of the first wall of sheet piling sections. After disassembly, the exposed AZ38-700 sheet piling sections were found to be in good condition with only slight warping. After review of the data, the deflection was found to be negative, which accounted for the steel expansion force overcoming the force applied to the top of the assembly (100-kips).

Example 2

The same sheet piling test assembly, which was used in Example 1, was mounted to the large vertical furnace with the AZ38-700 sheets exposed to the furnace environment. However, for this example, the water was drained from the bottom of the cavity through three shut-off valves to approximately 1 foot above the bottom of the assembly, without allowing the sand to drain. This "drained condition" is considered to be a dry sand condition for a typical application. The test of the assembly was conducted at an ambient temperature of 85° F. and a relative humidity of 40 percent. Prior to ignition of the furnace, the operation of the thermocouples was verified and a 100-kip load was applied to the top of the first wall of AZ38-700 sheet piling sections that was to be tested to simulate the loading from a structure and a 0.12-inch deflection was observed. The fire exposure was initiated and temperature data recorded using the data acquisition system. At 240 minutes, the test was terminated and the time-temperature curve was within the allowable 5 percent. Visual observations of the test are summarized in Table 3.

TABLE 3

Visual Observations

| TIME (Min:Sec) | OBSERVATION |
|---|---|
| 0:00 | Start test. |
| 1:00 | Burners set to full throttle to maintain the standard time-temperature curve. |
| 15:00 | Probe connectors outside of furnace melted causing malfunction in TCs 19, 20, and 26. |
| 18:00 | Steam observed escaping from top of assembly. |
| 34:00 | Loud popping noise heard coming from assembly. |
| 37:00 | Gas reduced to burners to accurately follow the time-temperature curve. |
| 60:00 | Maintaining load and time-temperature curve on target. |
| 65:00 | Water continues to drain slowly from drain ports. |
| 117:00 | TC 14 fails. |
| 180:00 | Water continues to slowly drain. |
| 199:00 | TC 3 is observed to be dropping in temperature. |
| 221:15 | Water continues to slowly drain. |
| 240:00 | Furnace shut off. Test terminated. |

The first wall formed by the sheet piling sections did not allow the passage of flames and was capable of maintaining a 100-kip load during the 4-hour (240 minutes) fire resistance test period. The test assembly was allowed to cool and disassembled to make closer observations. After disassembly, the exposed AZ38-700 sheet pilings were found to be in good condition with major warping. A review of the data showed the deflection of the sheet piling wall was negative for the first 40 minutes of the test, which indicated that the steel expansion force was greater than the force applied to the top of the assembly (100-kips). After 40 minutes, the load overcame the expansion force and the sheet piling wall began to deform and warp, but never to a point of ultimate failure. The test demonstrated that the load-bearing first wall of sheet piling sections met the performance criteria for flaming on the unexposed side, while maintaining the 100-kip load for a 4-hour fire resistance rating.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

I claim:

1. An assembly for testing the fire performance of sheet piling sections comprising:

a first wall formed by at least one sheet piling section and having a first top edge and a first pair of opposing ends;

a second wall substantially parallel to the first wall and having a second top edge and a second pair of opposing ends;

a base plate; and a pair of end sections extending between the first pair of opposing ends and the second pair of opposing ends;

wherein the first and second walls and the pair of end sections are attached to, and extend upwardly from, the base plate to form a cavity, wherein the first wall has an interior surface that faces the second wall, and wherein a plurality of temperature measuring devices contact the interior surface of the first wall.

2. The assembly for testing the fire performance of sheet piling sections according to claim 1, wherein the cavity is adapted to contain solid materials or a combination of solid and liquid materials.

3. The assembly for testing the fire performance of sheet piling sections according to claim 1, wherein a plurality of adjoining sheet piling sections forms the first wall, wherein each sheet piling section has a pair of side edges, wherein the plurality of adjoining sheet piling sections are connected to each other at the side edges to form a plurality of joints, and wherein the plurality of joints are welded.

4. The assembly for testing the fire performance of sheet piling sections according to claim 1, wherein the first wall, second wall, the pair of end sections and the base plate are attached by a plurality of welds, a plurality of bolts, a plurality of rivets or a combination of two or more thereof.

5. The assembly for testing the fire performance of sheet piling sections according to claim 1, wherein the temperature measuring devices are thermocouples or resistance temperature detectors.

6. The assembly for testing the fire performance of sheet piling sections according to claim 1, further comprising:

a first top section attached to the first top edge;

a second top section attached to the second top edge; and at least one connector, wherein the first top section is joined to the second top section by the at least one connector.

7. The assembly for testing the fire performance of sheet piling sections according to claim 6, wherein the second wall is constructed from a plurality of sheet piling sections and wherein the cavity is adapted to contain sand or a mixture of sand and water.

8. The assembly for testing the fire performance of sheet piling sections according to claim 6, wherein the at least one connector is a bolt, a strap or a connecting plate.

9. The assembly for testing the fire performance of sheet piling sections according to claim 6, wherein the second wall comprises one or more apertures.

10. An assembly for testing the fire performance of sheet piling sections comprising:

a first wall formed by at least one pair of sheet piling sections having an exterior surface, an interior surface, a top edge and a first pair of opposing ends;

a second wall substantially parallel to the first wall and having a second top edge and a second pair of opposing ends, wherein the interior surface of the first wall faces the second wall;

a base plate;

a pair of end sections extending between the first pair of opposing ends and the second pair of opposing ends;

a first top section attached to the first top edge;

a second top section attached to the second top edge, wherein the first top section is joined to the second top section by at least one connector; and a plurality of temperature measuring devices in contact with the interior surface of the first wall;

wherein the first and second walls and the end sections are attached to, and extend upwardly from, the base plate to form a cavity, wherein the cavity is adapted to contain solid materials or a combination of solid and liquid materials.

11. The assembly for testing the fire performance of sheet piling sections according to claim 10, wherein the cavity is adapted to contain sand or a mixture of sand and water.

12. The assembly for testing the fire performance of sheet piling sections according to claim 10, wherein a plurality of adjoining sheet piling sections forms the first wall, wherein each sheet piling section has a pair of side edges, wherein the plurality of adjoining sheet piling sections are connected to each other at the side edges to form a plurality of joints, and wherein the plurality of joints are welded.

13. The assembly for testing the fire performance of sheet piling sections according to claim 10, wherein the first wall, second wall, the pair of end sections and the base plate are attached by a plurality of welds, a plurality of bolts, a plurality of rivets or a combination of two or more thereof.

14. The assembly for testing the fire performance of sheet piling sections according to claim 10, wherein the at least one connector is a bolt, a strap or a connecting plate.

15. The assembly for testing the fire performance of sheet piling sections according to claim 10, wherein the second wall comprises one or more apertures.

16. An assembly for testing the fire performance of sheet piling sections comprising:

a first wall formed by a plurality of adjoining sheet piling sections, wherein each sheet piling section has a pair of side edges, wherein the plurality of adjoining sheet piling sections are connected to each other at the side edges to form a plurality of joints, wherein the plurality of joints are welded, and wherein the first wall has an exterior surface, an interior surface a first top edge, and a first pair of opposing ends;

a second wall substantially parallel to the first wall, wherein the second wall has a second top edge and a second pair of opposing ends, and wherein the interior surface of the first wall faces the second wall;

a base plate;

a pair of end sections extending between the first pair of opposing ends and the second pair of opposing ends;

a first top section attached to the first top edge;

a second top section attached to the second top edge, wherein the first top section is joined to the second top section by at least one connector; and a plurality of temperature measuring devices in contact with the interior surface of the first wall;

wherein the first and second walls and the pair of end sections are attached to and extend upwardly from, the base plate to form a cavity, wherein the cavity is adapted to contain solid materials or a combination of solid and liquid materials.

17. The assembly for testing the fire performance of sheet piling sections according to claim 16, wherein the cavity is adapted to contain sand or a mixture of sand and water.

18. The assembly for testing the fire performance of sheet piling sections according to claim 16, wherein the first wall, second wall, the pair of end sections and the base plate are attached by a plurality of welds, a plurality of bolts, a plurality of rivets or a combination of two or more thereof.

19. The assembly for testing the fire performance of sheet piling sections according to claim 16, wherein the at least one connector is a bolt, a strap or a connecting plate.

20. The assembly for testing the fire performance of sheet piling sections according to claim 16, wherein the second wall comprises one or more apertures.

21. A method for testing the fire performance of sheet piling sections comprising:

constructing an assembly comprising:

a first wall formed by at least one sheet piling section and having an interior surface, an exterior surface, a first top edge and a first pair of opposing ends;

a second wall substantially parallel to the first wall and having a second top edge and a second pair of opposing ends, wherein the interior surface of the first wall faces the second wall;

a base plate; and a pair of end sections extending between the first pair of opposing ends and the second pair of opposing ends; wherein the first and second walls and the end sections are attached to, and extend upwardly from, the base plate to form a cavity;

placing materials in the cavity;

providing a heat source of at least 500° F.; and exposing the exterior surface of the first wall to the heat source.

22. The method for testing the fire performance of sheet piling sections according to claim 21, wherein the assembly further comprises:

a plurality of temperature measuring devices in contact with the interior surface of the first wall;

a first top section attached to the first top edge;

a second top section attached to the second top edge; and at least one connector, wherein the first top section is joined to the second top section by the at least one connector.

23. The method for testing the fire performance of sheet piling sections according to claim 22, wherein the materials placed in the cavity are solid materials or a combination of solid and liquid materials.

24. The method for testing the fire performance of sheet piling sections according to claim 22, further comprising applying a load to the first top section.

25. The method for testing the fire performance of sheet piling sections according to claim 24, wherein the materials placed in the cavity are sand or a combination of sand and water.

26. The method for testing the fire performance of sheet piling sections according to claim 24, further comprising using the temperature measuring devices to measure temperatures when the exterior surface of the first wall is exposed to the heat source.

27. The method for testing the fire performance of sheet piling sections according to claim 26, further comprising recording the measured temperatures over a period of time.

28. The method for testing the fire performance of sheet piling sections according to claim 27, further comprising comparing the recorded temperatures to a fire performance standard for building materials.

* * * * *